United States Patent [19]

Steenbergen et al.

[11] Patent Number: 4,929,126

[45] Date of Patent: May 29, 1990

[54] METHOD FOR INSTALLING A SCREEN OF FLEXIBLE MATERIAL IN THE SOIL

[75] Inventors: Bastiaan G. Steenbergen, Essen, Belgium; Arie A. Hofman, Renkum; Willem De Waard, Oud-Beijerland, both of Netherlands

[73] Assignee: Digging Trading Company N.V., Klaaswaal, Netherlands

[21] Appl. No.: 144,087

[22] Filed: Jan. 15, 1988

[30] Foreign Application Priority Data

Jan. 21, 1987 [NL] Netherlands ..... 8700147

[51] Int. Cl.[5] ..... E02D 5/18

[52] U.S. Cl. ..... 405/267; 405/129; 405/258

[58] Field of Search ..... 405/267, 50, 154, 176, 405/156, 258, 268, 128, 129; 248/49; 160/328, 389

[56] References Cited

U.S. PATENT DOCUMENTS

| | | | |
|---|---|---|---|
| 2,009,329 | 7/1935 | Scherer | 160/328 X |
| 2,280,697 | 4/1942 | Gaines | 160/389 |
| 3,396,541 | 8/1968 | Lamberton | 405/50 |
| 3,452,546 | 7/1969 | Novet | 405/267 |
| 3,990,200 | 11/1976 | Kawaski et al. | 405/267 X |
| 4,543,016 | 9/1985 | Tallard | 405/52 X |
| 4,741,644 | 5/1988 | Cavalli et al. | 405/267 X |

FOREIGN PATENT DOCUMENTS

| | | | |
|---|---|---|---|
| 0143168 | 8/1980 | German Democratic Rep. | 405/267 |
| 0654740 | 3/1974 | U.S.S.R. | 405/258 |

*Primary Examiner*—Dennis L. Taylor

*Attorney, Agent, or Firm*—Dennison, Meserole, Pollack & Scheiner

[57] ABSTRACT

For installing a screen of flexible material in the soil, a trench is dug in the soil and the screen is fed into the trench. To provide a method in which the sagging or dragging along of the screen by the collapsing soil is avoided in a simple manner without use having to be made of an additional machine or the like, facilities are added to the screen itself to prevent its sagging into the still unfilled trench. The facilities may consist of a wire strung through the top edge of the screen and held under a certain tension, a strip which is bonded along the top edge of the screen and which is held under a certain tension, or an inflatable sleeve fitted to the top edge of the screen. Further it is possible that the entire screen is constructed in a sleeve-like form and is filled with gas, liquid or substance.

11 Claims, 2 Drawing Sheets

Figure 1:
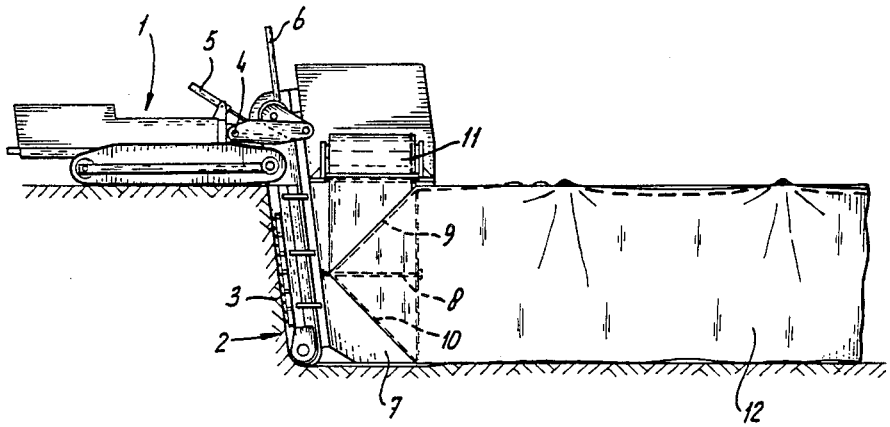

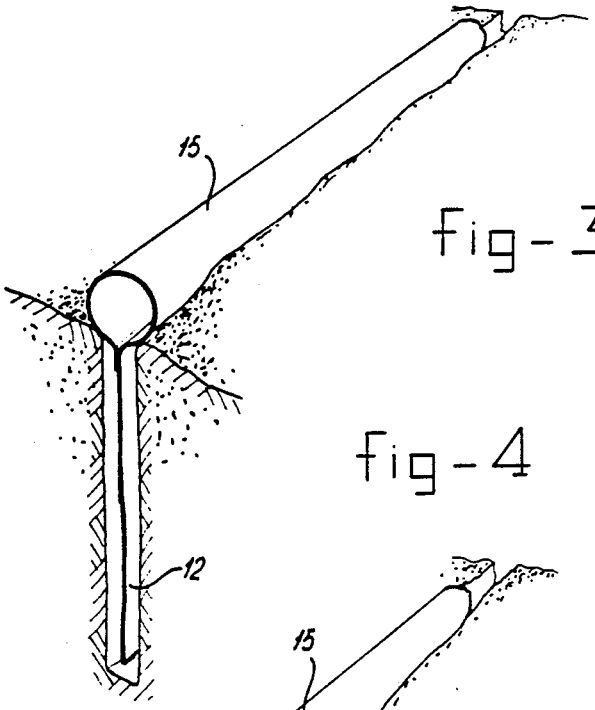
Fig-3
Fig-4
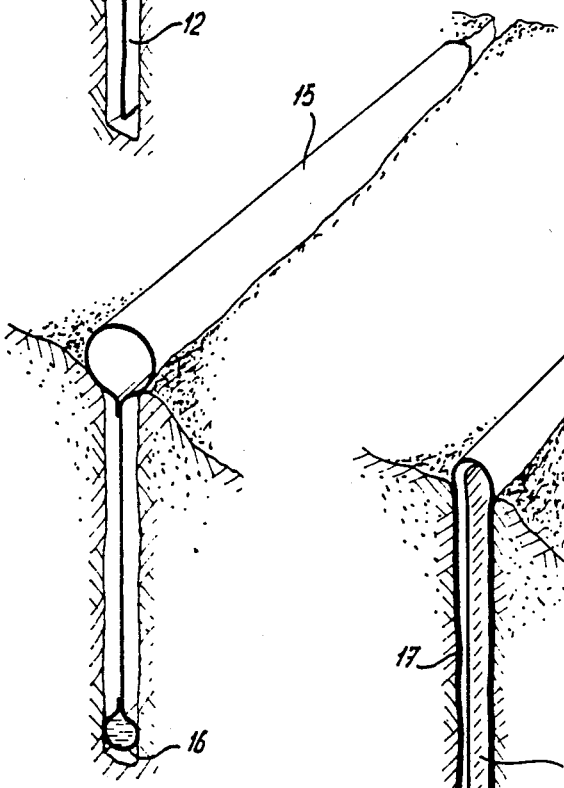
Fig-5
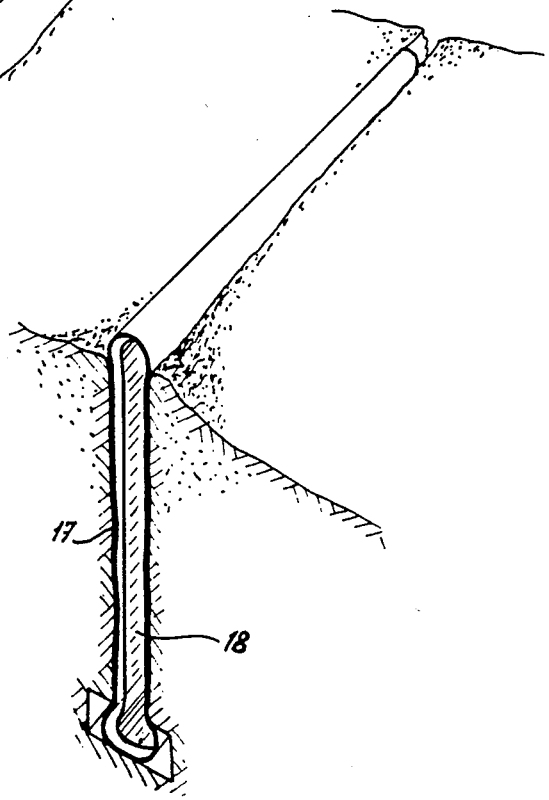

METHOD FOR INSTALLING A SCREEN OF FLEXIBLE MATERIAL IN THE SOIL

The invention relates to a method for installing a screen of flexible material in the soil, in which a trench is dug in the soil and the screen is fed into the trench.

A method of this sort is described in the Dutch Patent Application 69.00976 and the European Patent Application 86.200.189.8 (publication number: 0,191,533).

Such a screen is used, inter alia, to prevent spreading of pollutants by a horizontal soil water flow, to achieve a difference in water level on either side of the screen, to restrain muskrats and to prevent disturbance of a dike as a result of water seepage to the dry land side. Usually the screen consists of a stiff plastic film, but the possibilities also include other materials such as impregnated paper and sandwiches of paper and bitumen.

The European Patent Application mentioned describes how, and demonstrates that, digging of the trench, temporarily keeping said trench open and introducing the screen into the trench is carried out with one and the same machine.

It has been found that, in the case of the known methods, there is a risk of the flexible screen sagging or being dragged downwards under the influence of gravity or collapsing soil. Said sagging of the screen in an uncontrollable manner may result in a serious delay. This could be avoided by squeezing the top of the trench at intervals by means of an excavator travelling alongside the trench. This method requires an additional machine with a skilled driver. In addition, the width of the working strip is relatively large. Another method would be to cut off wedge-shaped pieces from the top edge of the trench and to secure the top edge of the screen therewith. This method is also labour-intensive and would not lead to reliable results. The most obvious method of avoiding sagging of the screen is to secure the top edge of the screen with pegs or sticks to the top edge of the trench. However, if the trench collapses, the screen is found to drop a number of decimeters along with the pegs or sticks.

The object of the invention is to provide a method of the type mentioned in the introduction in which the sagging or dragging along of the screen by the collapsing soil is avoided in a simple manner without use having to be made of an additional machine or the like.

According to the invention, for this purpose, facilities are added to the screen itself to prevent it sagging into the still unfilled trench.

In principle there are two possibilities: one in which the top edge of the screen is, as it were, suspended on a member held under tension, and one in which the film consists of a sleeve-type bag which is filled with gas or liquid and clamped between the walls of the trench.

The member on which the screen is suspended may consist of a wire strung through the top edge of the screen and held under a certain tension, a strip which is bonded along the top edge of the screen and which is held under a certain tension, and an inflated sleeve fitted to the top edge of the screen.

In the case of a wire, the screen could be folded double over said wire.

If the strip mentioned is used, it can be reinforced by reinforcing cords.

The bottom edge of the screen may also be provided with a sleeve which is filled with gas or liquid. By filling this lowermost sleeve with water or another liquid, buoyancy can be prevented. In addition, leak detection can be carried out with such a sleeve-like bag.

If the film is constructed in the form of a sleeve filled with gas, buoyancy can be prevented by widening both the trench and the filled sleeve-like screen at the bottom.

To prevent the entire sleeve-type bag deflating in the in the event of one single leak, the sleeve-like screen could be divided into compartments by approximately vertical seams. Each compartment is filled, for example, separately via a valve. Any compartment which may have become leaky is held upright by the non-leaky compartments.

The invention relates also to a screen which is clearly intended for use in the above-described methods.

The invention will now be explained in more detail by reference to the figures in which a number of exemplary embodiments of the method according to the invention is shown.

FIG. 1 shows a side view of a machine for installing a flexible screen in the soil, the protective housing connected to the machine being sectioned in the longitudinal direction for clarity.

FIGS. 2 to 5 inclusive show perspective views of a number of embodiments in which a screen installed in the soil is provided with means for preventing sagging into the dug trench.

The trench excavating machine 1 which is shown in FIG. 1 and is known per se comprises an excavating beam 2 which is provided with an excavating chain 3 and has a pivot point at 4. The excavating beam can be tilted through a certain angle by means of two hydraulic cylinders 5. Two hydraulic cylinders 6 are present to make it possible to adjust the depth of the excavating beam. A protective housing 7 is attached to the machine and can be used to keep the dug trench open over a certain distance. Moreover, there are a number of rollers 8, 9, 10 in the protective housing and above the housing a supply roll 11 of film is provided. The doubly folded film 12 which is drawn off the roll 11 is unfolded by means of the rollers 8, 9, 10 and fed into the trench. Details are described in the European Patent Application 86.200.189.8 (publication number: 0,191,533). Of course, a screen which is not doubly folded beforehand can also be installed in the trench.

Figure 2:
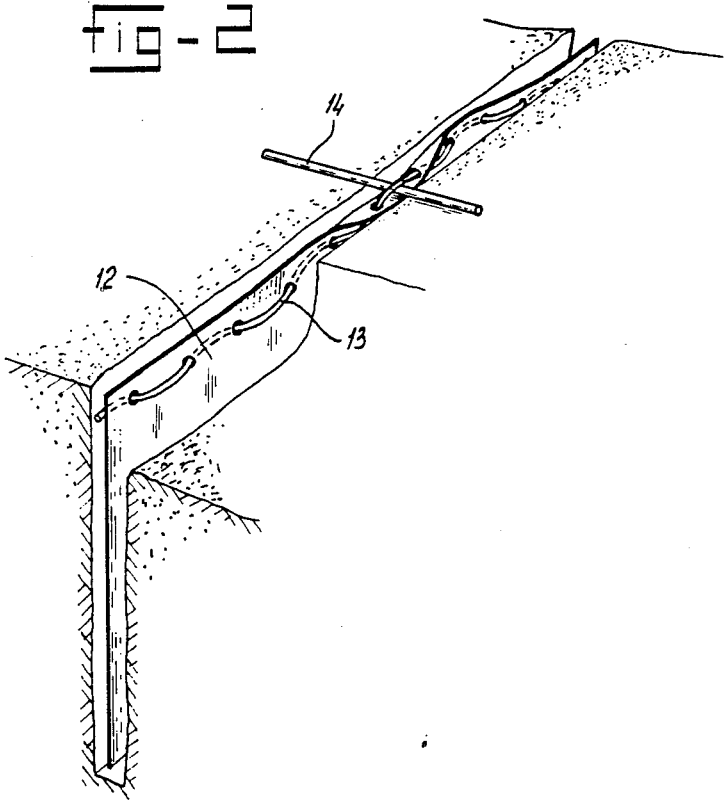

According to the invention, facilities are added to the screen to prevent sagging thereof into the as yet unfilled trench. In FIG. 2 these means consist of a wire 13 strung through the upper edge of the screen. The film is provided for the purpose of stringing with openings having a suitable spacing. The starting point of said wire 13 is fixed and the wire is held under a certain tension so that the sag of the film into the open trench is open trench is controlled. As soon as the trench has been filled in a natural manner or mechanically, the tension in the wire can be removed. The film 12 in the open trench is thus suspended on the wire 13. Said wire will sag as a function of the tensile force, the weight of the film and the free span. The free span length is thus limited to relatively short pieces. In order to solve this problem, the sheet of film may be additionally supported at certain intervals with sticks 14 which are thrust between the wire 13 and the top edge of the foil 12. Said sticks support at the surface level. It should be possible to recover and reuse the suspension wire after the trench has been filled. Instead of using a wire strung through the top edge, the suspension of the film in the trench can also be achieved in principle by

- a plastic strip, possibly reinforced with cords and held under tension, is firmly glued to the top edge of the film,

- providing wire loops beforehand on the film at mutual intervals through which sticks are thrust,

- a suspension wire is laid between a doubly folded film sheet, it being possible for said wire to be supported by means of clamps which rest on the surface level.

A practical solution to the problem of the film installed in the open trench failing to remain upright is shown in FIG. 3: the film is provided at its top edge with a sleeve 15 which, after the film has been installed in the trench, is inflated. The diameter of the cross section of said sleeve is such that the sleeve is securely clamped in the trench or rests on the surface level. For example, a valve debouching into the sleeve is provided at the beginning of a film sheet. There is the possibility of making use of a large number of sleeve sections, which are separated from each other by non-sleeve-like double-walled film sections instead of a sleeve running along a great length. Each sleeve section then has its own valve.

FIG. 4 shows a variant: the bottom edge of the film is also provided with a sleeve 16 into which preferably water or another liquid is fed after it has been installed in the trench. This lowermost sleeve prevents buoyancy.

In FIG. 5 it can be seen that the entire film is constructed in the form of a sleeve 17 and after it has been installed in the trench, it is inflated so that it is securely clamped in the trench.

The possibility is not excluded that the sleeve of film is filled with a medium other than air, for example with water. A compound which remains plastic or which sets is also possible. As a result of this buoyancy can be completely avoided. Inflating the sleeve or filling it with liquid or substance contributes to preventing the trench collapsing rapidly.

To prevent the film completely deflating if there is a leak in it, the sleeve of film can be divided into compartments by bonding two walls of the film locally to each other in the transverse direction as suggested at 18 in FIG. 5. Each compartment has its own filling valve. If a compartment becomes leaky, the film of said compartment is held up by the adjacent compartments. The compartments may have the form of columns which may be in communication with each other as groups.

The use of a setting compound in the sleeve of film results in a very reliably protective wall. The fact that the soil next to the wall of the trench do not collapse may benefit the stability of the environment (underpinning of building).

If the sleeve of film according to FIG. 4 is inflated with air, there is a risk of buoyancy as a result of water or mud present in the trench. This may be prevented by ballast material, which is an expensive method. It is cheaper to widen the trench at the bottom in accordance with FIG. 5 and also to construct the sleeve 17 more widely at the bottom in the inflated state. To dig a trench with a widened lowermost section, use may be made, for example, of the machine according to FIG. 4 of the European Patent Application 86.200.189.8 (publication number: 0,191,533).

Various modifications are possible within the scope of the invention. The essential point is that the screen is constructed in a manner such that, or is provided with means such that, it does not drop into the still open trench. An advantage of the method is that it can be used in a winding stretch without problems.

We claim:

1. In a ground barrier including a vertical longitudinally elongate trench and a barrier screen positioned vertically within and longitudinally along said trench, said trench including an open top and a bottom, said screen including a top edge generally at the open top of said trench, and a bottom edge generally adjacent the bottom of said trench; the improvement wherein said screen comprises an elongate inflatable sleeve formed longitudinally along at least said top edge of said screen, and inflatable to transversely span said trench and define a substantially continuous support for said screen within said trench.

2. The barrier of claim 1 wherein a second inflatable sleeve is formed longitudinally along said bottom edge of said screen and transversely expandable across said trench for stabilization of said screen within said trench.

3. The barrier of claim 1 wherein said sleeve extends for substantially the full extent of said screen within said trench and is transversely expandable to span and clamp within said trench between said open top of said trench and said bottom of said trench.

4. In a ground barrier including a vertical longitudinally elongate trench and a barrier screen positioned vertically within and longitudinally along said trench, said trench including an open top and a bottom, said screen including a top edge generally at the open top of said trench, and a bottom edge generally adjacent the bottom of said trench; the improvement wherein said screen, for the full extent thereof within said trench, is an inflatable sleeve transversely expandable to span and clamp within said trench between said open top of said trench and the bottom of said trench, said inflatable sleeve defining a substantially continuous support for said screen within said trench.

5. The barrier of claim 4 wherein said trench, adjacent the bottom and along the length of the trench, includes a portion wider than the remainder of the trench, said screen inflatable sleeve being wider along the bottom edge and expandable into the wider portion of the trench.

6. The barrier of claim 5 wherein said screen inflatable sleeve is divided into vertical compartments.

7. In a method of installing a ground barrier including the steps of digging an open top, vertical, longitudinally elongate trench, and feeding a screen of flexible material into and longitudinally along said trench with an upper edge portion of the screen extending longitudinally along the open top of the trench and a bottom edge portion adjacent the bottom of the trench; the improvement comprising the step of inflating at least a longitudinal portion of said screen and transversely expanding said portion to span the trench at least adjacent the open top thereof.

8. The method of claim 7 including the step of inflating a second longitudinal portion of said screen and transversely expanding said second longitudinal portion of said screen adjacent the bottom of the trench.

9. The method of claim 7 wherein said screen is inflated and transversely expanded throughout the full height thereof.

10. In a method of installing a ground barrier including the steps of digging an open top, vertical, longitudinally elongate trench, and feeding a screen of flexible material into and longitudinally along said trench with an upper edge portion of the screen extending longitudinally along the open top of the trench and a bottom edge portion adjacent the bottom of the trench; the improvement comprising the step of inflating and transversely expanding said screen throughout the full height thereof to span said trench.

11. The method of claim 10 wherein the bottom edge portion of the screen is transversely expanded beyond the remainder of the expanded screen.

* * * * *